US005547225A

United States Patent [19]

DeAngelis

[11] Patent Number: 5,547,225

[45] Date of Patent: Aug. 20, 1996

[54] PRINTING METHOD AND APPARATUS

[76] Inventor: Andrew V. DeAngelis, 164 Kirkwood Ct., Bloomfield Hills, Mich. 48304

[21] Appl. No.: 168,752

[22] Filed: Dec. 16, 1993

Related U.S. Application Data

[63] Continuation-in-part of Ser. No. 902,840, Jun. 23, 1972, Pat. No. 5,320,334.

[51] Int. Cl.[6] ..... B42D 1/00

[52] U.S. Cl. ..... 281/211; 281/38; 402/79; 283/56

[58] Field of Search ..... 281/38, 15.1, 21.1, 281/2, 5; 402/79, 80 K; 283/62, 56

[56] References Cited

U.S. PATENT DOCUMENTS

| | | | |
|---|---|---|---|
| Re. 26,049 | 6/1966 | Fischer et al. | 283/56 |
| 429,891 | 6/1890 | Crowell . | |
| 804,293 | 11/1905 | Wood . | |
| 882,800 | 3/1908 | Scott . | |
| 890,720 | 6/1908 | Southgate . | |
| 1,109,152 | 9/1914 | Spalckhaver . | |
| 1,232,639 | 7/1917 | Wood . | |
| 1,436,818 | 11/1922 | Perkins . | |
| 1,970,929 | 8/1934 | Wood | 270/5 |
| 2,003,639 | 6/1935 | Wood | 270/5 |
| 2,016,309 | 10/1935 | Zuckerman | 270/11 |
| 2,025,927 | 12/1935 | Wood | 270/5 |
| 2,050,031 | 8/1936 | Wood | 270/5 |
| 2,160,527 | 5/1939 | Tornberg | 270/5 |
| 3,275,316 | 9/1966 | Cleary, Jr. | 270/57 |
| 3,582,111 | 6/1971 | Siiter | 283/56 |
| 3,588,085 | 6/1971 | Bailey et al. | 270/37 |
| 3,679,200 | 7/1972 | Bailey et al. | 270/4 |
| 3,833,466 | 9/1974 | McCarty | 162/142 |
| 3,899,381 | 8/1975 | O'Brien et al. | 156/204 |
| 4,010,964 | 3/1977 | Schechter | 283/56 |
| 4,046,366 | 9/1977 | McCain et al. | 270/21 |
| 4,305,605 | 12/1981 | Vine | 281/35 |
| 4,420,147 | 12/1983 | Knox | 270/37 |
| 4,682,767 | 7/1987 | Littleton | 270/45 |
| 5,098,127 | 3/1992 | Williamson et al. | 281/38 |
| 5,193,851 | 3/1993 | Honegger | 281/21.1 X |
| 5,269,563 | 12/1993 | Michlin | 281/38 X |
| 5,407,233 | 4/1995 | Wilen | 281/38 |

*Primary Examiner*—Willmon Fridie, Jr.

*Attorney, Agent, or Firm*—Gifford, Krass, Groh, Sprinkle, Patmore, Anderson & Citkowski, P.C.

[57] ABSTRACT

A method and apparatus for forming books comprising pages of coated paper interspersed with pages of newsprint paper. The book is formed by providing a moving web of coated paper, providing a plurality of moving webs of newsprint paper, printing the moving web of coated paper with inks of a plurality of colors including printing within identified coupon areas, selectively perforating the moving web of coated paper around the printed coupon areas, subjecting the moving web of coated paper to a heatset operation to set the inks on the web, printing the moving webs of newsprint paper with at least one color ink, and associating the moving webs of coated paper and newsprint paper in a pasting, folding, and cutting operation to form a plurality of books each comprising a plurality of pages of coated paper interspersed with a plurality of pages of newsprint paper and adhesively bound together along one longitudinal edge of the book and each including detachable coupons on at least some of the coated paper pages. An interleaver is also provided which enables the coated web to be selectively inserted with respect to the several moving webs of newsprint paper to selectively vary the relative positioning of the coated web and the newsprint webs prior to undergoing the pasting, folding and cutting operation so as to selectively vary the coated and newsprint page positioning in the finished book.

4 Claims, 7 Drawing Sheets

COVER INNER
COVER OUTER
C
CC
PC
CF OUTER
CF INNER

NP1
NP2
NP3
58a
58
C2
C1
52
54
56
60
62
64
66
68
70
72
74
76
78
80
100

C
58a

FIG-9A
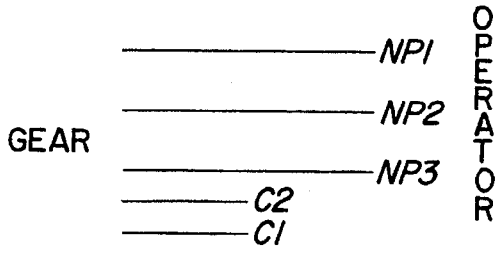
FIG-9B
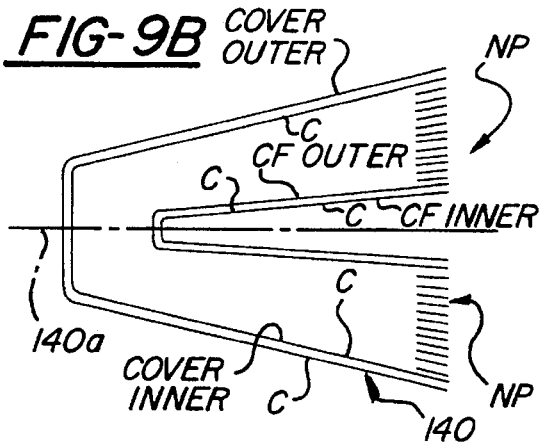
FIG-10A
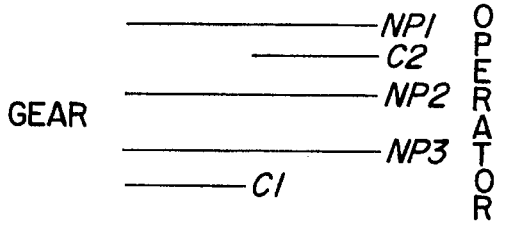
FIG-10B
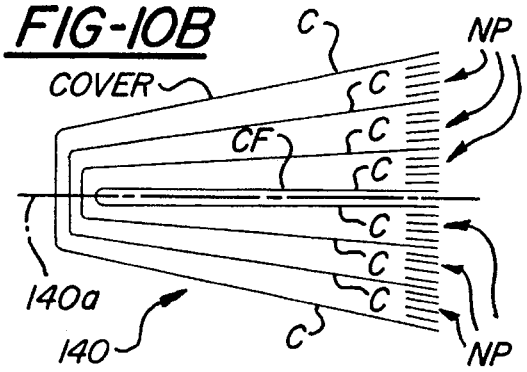
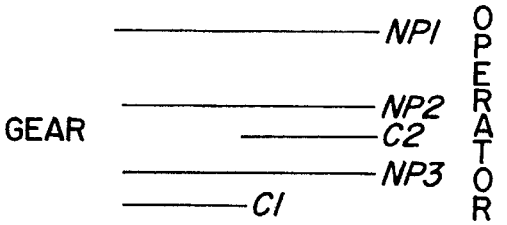
FIG-11A
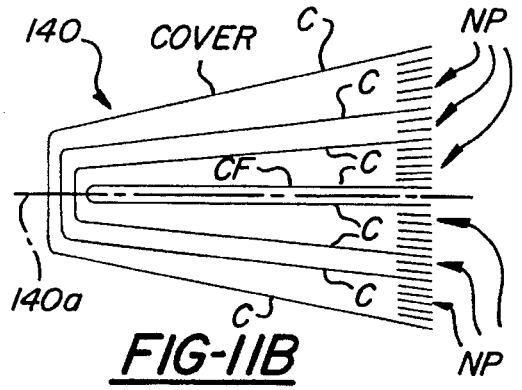
FIG-11B
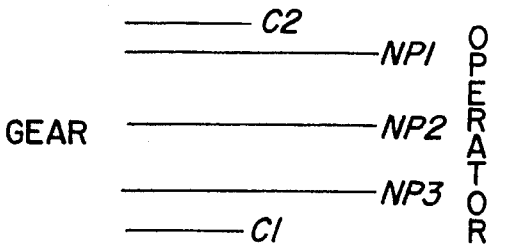
FIG-12A
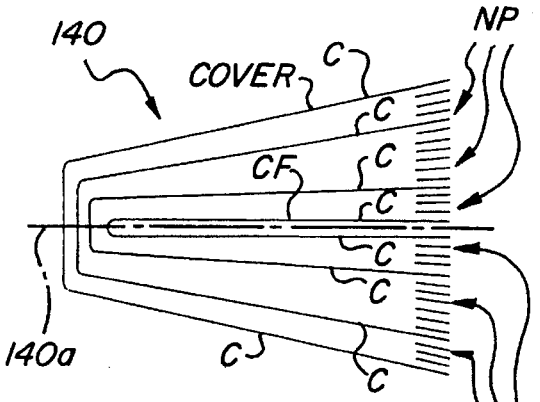
FIG-12B

PRINTING METHOD AND APPARATUS

REFERENCE TO RELATED APPLICATION

This application is a continuation-in-part of U.S. Ser. No. 902,840, filed Jun. 23, 1992 now U.S. Pat. No. 5,320,330.

FIELD OF THE INVENTION

This invention relates to printing methods and apparatus and more particularly to the formation of books comprising pages of coated paper interspersed with pages of newsprint paper.

BACKGROUND OF THE INVENTION

There is a need in the printing industry to provide a cost-effective means of providing individual books, each comprising a plurality of pages of coated paper interspersed with a plurality of pages of newsprint paper. Such a book may comprise for example a TV book provided in association with a newspaper. It is desirable in such a book to have several pages of coated paper included in the book to accommodate and attract advertisers desiring glossy, multicolor advertising entries. In the past these books have been provided by separately printing, folding, and cutting one or more coated webs, placing the coated products in inventory, separately printing, folding, and cutting one or more newsprint webs, placing the newsprint products in inventory, and thereafter, at a convenient time and place bringing the coated and newsprint products together in a stapling operation to provide the final book. This separate printing of the coated and newsprint webs, followed by the final stapling of the coated and newsprint products together to form the book, is extremely expensive and time-consuming.

SUMMARY OF THE INVENTION

This invention is directed to the provision of an improved method and apparatus for forming books comprising pages of coated paper interspersed with pages of newsprint paper.

This invention is further directed to the provision of an improved method and apparatus for forming books containing pages of coated paper interspersed with pages of newsprint paper and further providing perforations on the interior coated pages of the book to facilitate the removal of coupons from the book.

This invention is further directed to the provision of an improved method and apparatus for forming books containing pages of coated pages interspersed with pages of newsprint paper and further providing an extreme versatility with respect to the relative positioning of the coated and newsprint pages within the book.

According to the invention methodology, first, second and third moving webs of paper are provided; the first, second and third moving webs of paper are printed at first, second and third printing stations, respectively; a folder is provided; an interleaver is provided; first and second web paths are defined for the first and second moving webs extending from the first and second printing stations respectively, extending through the interleaver along spaced but aligned interleaver path portions, and extending to the folder; a third web path is defined for the third moving web extending from the third printing station to the interleaver; and a plurality of alternate entry path portions are provided for the third web as it enters the interleaver with at least some of the entry path portions providing different interleave relations with respect to the spaced interleaver path portions of the first and second webs.

This arrangement allows the third web to be selectively interspersed between the first and second webs to produce, in combination with the subsequent folding operation, books having a wide variety of interspersed relative relationships as between the paper of the first, second and third webs.

According to a further feature of the invention methodology, the step of providing first, second and third moving webs of paper comprises providing first and second moving webs of newsprint paper and a third moving web of coated enamel paper. This methodology, utilizing the alternate entry path portions, allow the production of books having various interspersed relations of coated and newsprint pages.

According to a further feature of the invention methodology, the third moving web is passed through a heat set station and a chiller station after leaving the third printing station and before entering the interleaver. This arrangement ensures that the ink on the coated enamel paper is thoroughly dried prior to entering the interleaver so as to not create smudging during the interleaver process and the subsequent folding process.

According to a further feature of the invention methodology, the third moving web is passed through a perforating station after leaving the third printing station and before entering the interleaver. This arrangement allows selected printed areas on the coated enamel web to be delineated by perforations so as to provide coupons on selected coated pages in the finished book.

According to a further feature of the invention methodology, the third moving web is slit after it leaves the third printing station and before entering the interleaver to define a plurality of third web portions, and each of the third web portions is delivered to the interleaver along a different entry path portion. This arrangement further amplifiers the possible permutations with respect to the relative positionings of the coated and newsprint paper in the finished book.

According to a further feature of the invention methodology, a fourth moving web of paper is provided comprising a moving web of newsprint paper, the fourth moving web is printed at a fourth printing station, a fourth web path is defined for the fourth web extending from the fourth printing station and extending through the interleaver along an interleaver path spaced from but aligned with the interleaver path portions of the first and second webs, and the step of providing a plurality of entry path portions for the third web as it enters the interleaver comprises providing entry path portions for the third web providing interleaved relations with respect to the fourth web. The provision of a fourth moving web, in combination with the provision of entry path portions for the third web with respect to the fourth moving web, further augments the ability of the invention methodology to provide a wide variety of interspersed relations of coated and newsprint pages in the finished book.

The invention also provides an improved printing apparatus. The improved printing apparatus comprises means defining sources of first, second and third webs of paper; first, second and third printing units for printing the first, second and third webs of paper, respectively; a folder; an interleaver; means defining first and second web paths for the first and second webs extending from the respective web source to the respective first and second printing units, extending through the interleaver along spaced but aligned interleaver path portions, and extending to the folder; means defining a third web path for the third web extending from the respective web source to third printing unit and thence to the interleaver; and means defining a plurality of alternate entry path portions for the third web as it enters the interleaver with at least some of the entry path portions providing different interleave relations with respect to the spaced interleaver path portions of the first and second webs. This apparatus allows the production of books in which the paper of the first, second and third webs is interspersed within the book in a wide variety of interspersed combinations.

According to a further feature of the invention apparatus, the means defining a source of first, second and third webs of paper comprises means defining sources of first and second webs of newsprint paper and means defining a source of a third web of coated enamel paper. This arrangement allows coated enamel paper to be interspersed in the final book with pages of newsprint paper in a wide variety of combinations as determined by the specific entry path portion chosen for the third web as it enters the interleaver.

According to a further feature of the invention apparatus, the apparatus further includes a heat set station and a chiller station and the third web path extends from the third printing unit to the heat set station and thence to the chiller station and thence to the interleaver. This arrangement allows the printed coated enamel paper to be rapidly dried prior to entering the interleaver so as to avoid smudging during the interleaver operation and during the subsequent folding operation.

According to a further feature of the invention apparatus, the apparatus further includes a perforating station and the third web path extends from the third printing unit to the perforating station and thence to the interleaver. This arrangement allows the third web, prior to entering the interleaver, to be selectively perforated so as to provide coupon areas on the coated web for inclusion in the finished book at a location in the book determined by the particular entry path selected for the third web as it enters the interleaver.

According to a further feature of the invention apparatus, the apparatus further includes a slitter operative to slit the third web into a plurality of third web portions after the third web leaves the third printing unit and before it enters the interleaver, and means operative to deliver each of the third web portions to the interleaver along a different entry path portion. This arrangement further augments the ability of the apparatus to provide a wide variety of relative positionings of the coated and newsprint pages in the finished book.

The invention also provides an improved book. The book according to the invention comprises a plurality of pages of interspersed multi-color coated pages and newsprint pages adhesively bound along one of their common edges wherein each book has a front and rear cover page formed of multi-color coated paper, each book includes pages of coated paper interspersed between the cover pages with pages of newsprint paper, each page is formed as one half of a folded sheet, and the folded sheets are arranged in nested relation with all of the folds arranged on a single common center line passing through the common adhesively bound edge.

BRIEF DESCRIPTION OF THE DRAWINGS

FIGS. 9A and 9B, 10A and 10B, 11A and 11B, and 12A and 12B are views illustrating various book configurations producible utilizing the invention method and apparatus.

DETAILED DESCRIPTION OF THE PREFERRED EMBODIMENT

Figure 1:
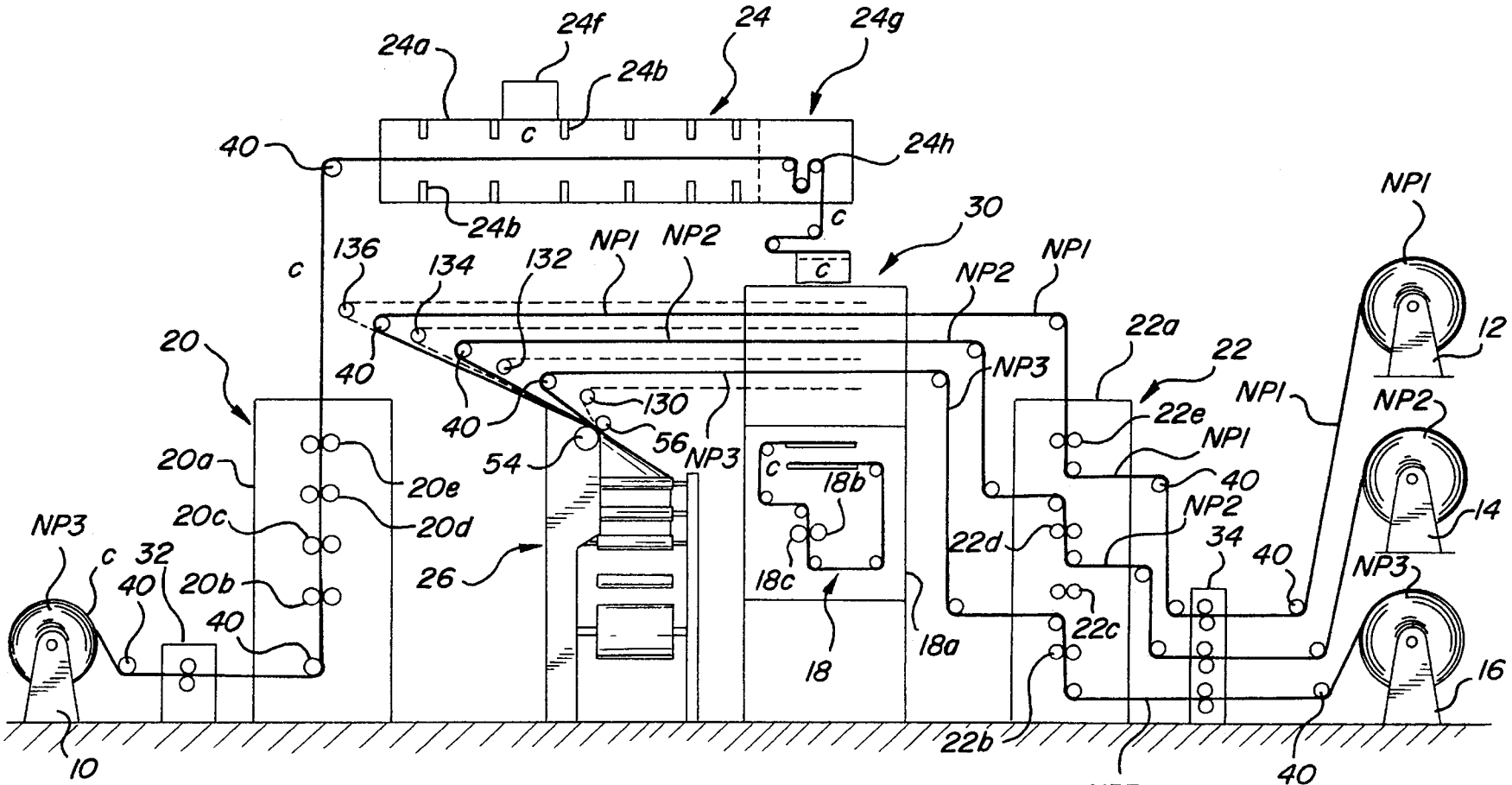
FIG. 1 is a somewhat schematic side elevational view of the invention printing apparatus.

The invention printing apparatus, as is customary, includes an operator side, providing operator access to the press, and a gear side, remote from the operator side.

The invention printing apparatus, broadly considered, includes web roll support stands 10, 12, 14, and 16; a perforating unit 18; printing units 20 and 22, a dryer or heatset unit 24; a folder 26; a trimmer 28; and an interleaver 30.

A web roll C of coated paper is supported on web roll support stand 10; web rolls NP1, NP2 and NP3 of newsprint paper are supported respectively on web roll support stands 12, 14 and 16; and a plurality of guide rollers 40 are provided to define the paths of the various webs as they move through the invention printing apparatus paper.

Web roll C may comprise, for example, a 34 inch wide web of 40 lb. No. 5 coated enamel groundwood paper and newsprint rolls NP1, NP2 and NP3 may comprise 34 inch wide web rolls of 30 lb. groundwood newsprint paper.

Perforating unit 18 includes a housing 18*a*, a perforating roller 18*b*, and a backing roller 18*c*.

Printing unit 20 may comprise a "four-high" including a housing 20*a* and four vertically stacked printing couples 20*b*, 20*c*, 20*d*, and 20*e*. Printing unit 20 is preferably of the offset type.

Printing unit 22 may also be of the "four-high" offset type and includes a housing 22*a* and vertically stacked printing couples 22*b*, 22*c*, 22*d*, and 22*e*.

Heatset unit 24 includes a housing 24*a*, a plurality of sets of opposed nozzles 24*b*, a source of hot air 24*f*, and a chill unit 24*g* including a plurality of chill rolls 24*h*. Heat source 24*f* may include an open gas flame providing heated air and a blower arranged to deliver the heated air to the nozzles 24*b*. Each chill roll 24*h* is hollow and is arranged to have refrigerant passed end to end through the chill roll in a closed loop manner with the refrigerant leaving one end of each chill roll and passing to a refrigeration unit 24*i* where it is cooled for resupply to the other end of the chill roll.

Folder 26 includes a housing and frame structure 50; a former 52; a roller-top-of-former 54; a pressure roller 56; adhesive nozzles 58; point-of-former rollers 60; nipper rollers 62; a cross-perforating roller 64 coacting with a backing roller 66; a cutting cylinder 68; a half-fold jaw cylinder 70; a rotary brush 72; a delivery board 74; a quarter folder 76; a delivery fly 78; and delivery belts 80.

Trimmer 28 is shown only schematically and includes an in-feed conveyor 90, a right angle transition conveyor 92, and trimming knives 94, 96, and 98.

Interleaver 30 is positioned, for example, on top of perforator 18 and below chiller 24*g*. The coated web C leaving chiller 24*g* is routed downwardly along the operator side of the press to the perforator 18, and is thereafter route upwardly into the interleaver for upward movement along the gear side of the press for selective delivery, along a plurality of alternate paths, in interspersed relation with respect to the moving webs NP1, NP2 and NP3 passing through the interleaver.

The path of the newsprint web NP1 through the invention apparatus, broadly considered, extends from the newsprint roll NP1, through a tensioning unit 34, through printing unit 22, through interleaver 30, through folder 26, and thence to trimmer 28.

Specifically, newsprint web NP1 extends from the roll around guide rollers 40 into the upper section of printing unit 22 where it passes upwardly through printing couple 22*e* to receive, for example, a black ink, whereafter the web leaves the upper end of the printing unit 22, passes around a guide roller 40, and moves forwardly for passage through interleaver 30, whereafter the web continues forwardly for passage around a guide roller 40, whereafter the web moves rearwardly for passage through the folder and thence to the trimmer 28.

The path of newsprint web NP2 extends from roll stand 14, around suitable rollers 40, through tension unit 34 and into the printing unit 22 where it passes upwardly through printing couple 22*a* to receive, for example, a black ink whereafter it passes out of the printing unit 22 and upwardly for passage around a further guide roller 40 and thereafter moves forwardly through interleaver 30 in downwardly spaced but aligned relation with respect to newsprint web NP1, whereafter it continues forwardly and around a guide roller 40, whereafter it moves rearwardly for entry into the folder and passage through the folder to the trimmer 28.

Newsprint web NP3 extends from roll stand 16 through tensioner 34, upwardly through the printing couple 23*b* of printing unit 22 where it receives, for example, a black ink, whereafter the web passes upwardly for passage around a further guide roller 40 and thereafter moves forwardly through interleaver 30 in downwardly spaced but aligned relation with respect to newsprint web NP2, whereafter it continues forwardly and around a guide roller 40, whereafter it moves rearwardly for entry into the folder and passage through the folder to the trimmer.

The path of coated web C through the invention printing apparatus, broadly considered, extends from the coated web roll C through a tensioning unit 32 to printing unit 20, to the heatset unit 24, to perforator 18, to interleaver 30, to folder 26, and thence to trimmer 28.

Specifically, coated web C extends from the coated web roll over a guide roller 40 and enters the tension unit 32; thereafter passes upwardly out of the tensioning unit and around a guide roller 40 to enter the lower end of printing unit 20 where it passes upwardly through the four printing couples 20*b*, 20*c*, 20*d* and 20*e* to receive four different color impressions from the respective four printing couples; thereafter passes upwardly out of the printing unit and over a guide roller 40 and moves rearwardly through the heatset unit 24 where it is initially exposed to the nozzles 24*b* supplied with hot drying air from the heater unit 24*f* to heat the web and the ink lying on the coated surfaces of the web, whereafter the web passes over the chill rollers 24*h* of chiller 24*g* where it is chilled to set the ink on the coated surface of the web, whereafter the web leaves the lower end of the heat set unit and passes around forward and rearward guide rollers 40, moves rearwardly for passage around a turn bar 100, moves laterally outwardly to the operator side of the press for passage over a guide roller 40, moves downwardly along the operator side of the press, moves around a guide roller 40 and laterally inwardly into perforator 18 to a turn bar 102, thereafter moves rearwardly for passage around a guide roller 40, thereafter moves downwardly within the perforator for passage around a further guide roller 40, thereafter moves forwardly within the perforator for passage around a further guide roller 40, thereafter moves upwardly for passage through perforator rollers 18*b*, 18*c*, thereafter moves around a further guide roller 40 for forward movement within the perforator to a further guide roller 40, thereafter moves upwardly within the perforator and moves around a further guide roller 40, thereafter moves rearwardly within the perforator for passage around a turn bar 104, and thereafter moves laterally outwardly to the gear side of the press.

At the gear side of the press, the coated web passes around a slitter roller 106, power driven by a motor 108, where the web is slit in half by a slitter 106*a* to form coated web halves C1 and C2. The two coated web halves then move upwardly into the interleaver for upward movement along the gear side of the interleaver. As the web halves C1 and C2 move upwardly along the gear side of the interleaver they move selectively around first and second guide rollers, respectively, of a set of vertically spaced guide rollers 110, 112, 114, 116 and 118 and move laterally inwardly along a plurality of alternate interleaver entry path portions to an interleaved relation with respect to one or more of the vertically spaced newsprint webs NP1, NP2 and NP3 passing through the interleaver, whereafter the web halves move around first and second turn bars of a set of vertically spaced turn bars 120, 122, 124, 126 and 128 and move forwardly in interleaved relation to the webs NP1, NP2 and NP3 to one or more guide rollers 130, 132, 134, and 136 from where they move rearwardly for entry into the folder, whereafter, after passing through the folder, they are delivered to the trimmer 28 for suitable trimming operations.

Figure 13:
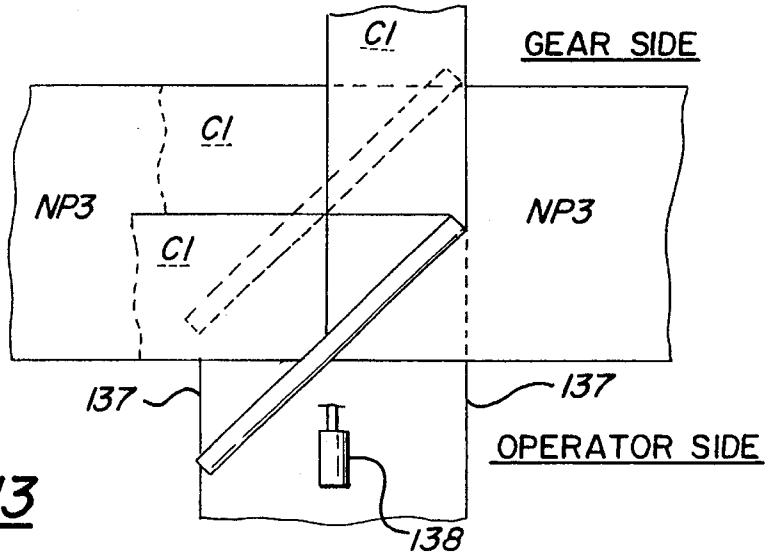
FIG. 13 is a schematic view illustrating the selective positioning of turn bars utilized in the invention printing apparatus.

As best seen in FIG. 13, each turn bar 120, 122, 124, and 126 may be selectively moved in a translatory manner along suitable guide tracks 137 utilizing suitable motor means 138 to selectively vary the registry of each coated web half C1, C2 with respect to the newsprint webs and to selectively determine whether the web half C1, C2 is positioned on the gear side or the operator side of the newsprint webs.

Figures 1A, 1B, 3:
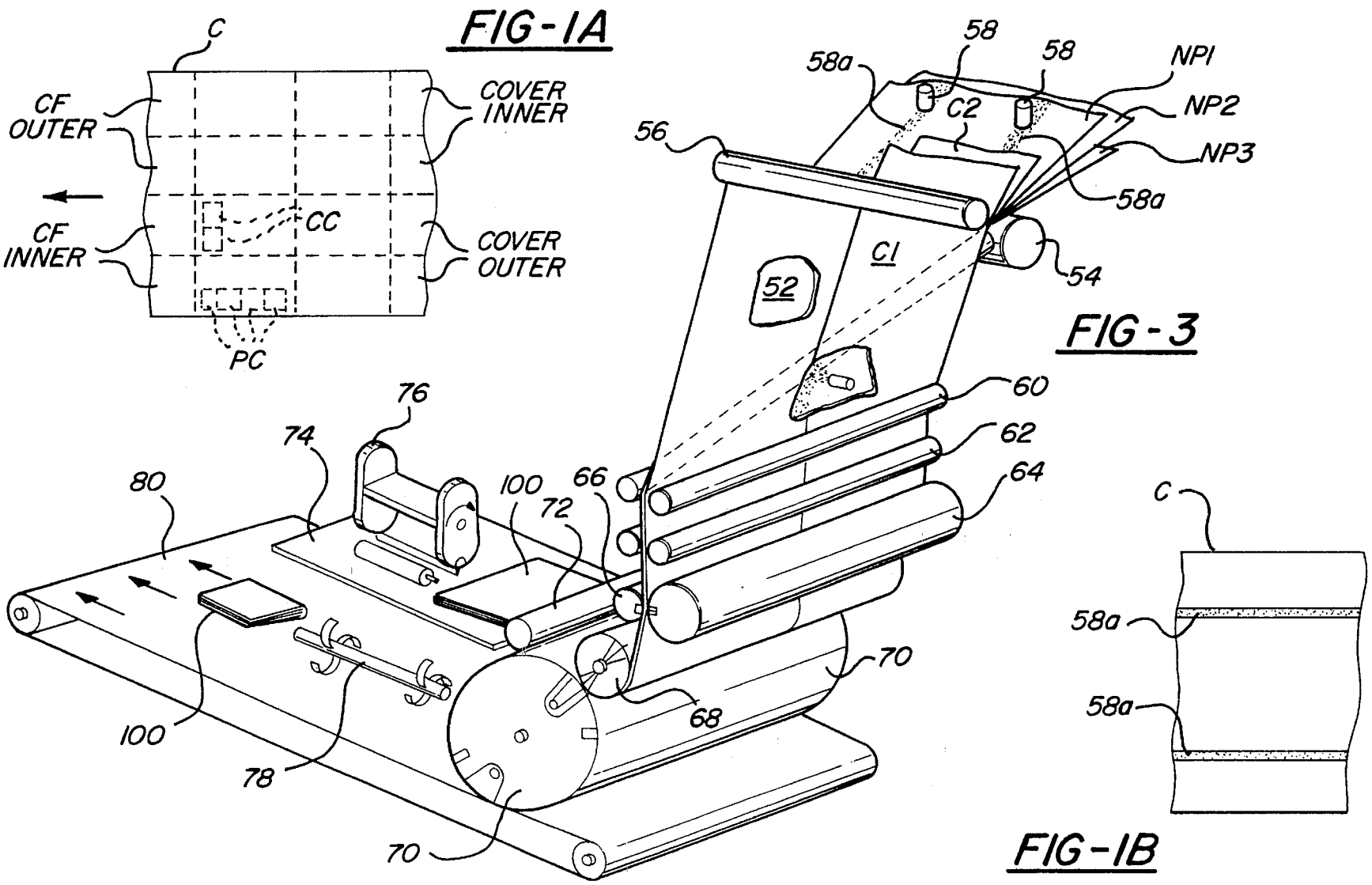
FIGS. 1A and 1B are fragmentary views of a coated web of paper moving through the invention printing apparatus.
FIGS. 3 and 4 are fragmentary views of a folding unit employed in the invention printing apparatus.
Figure 2:
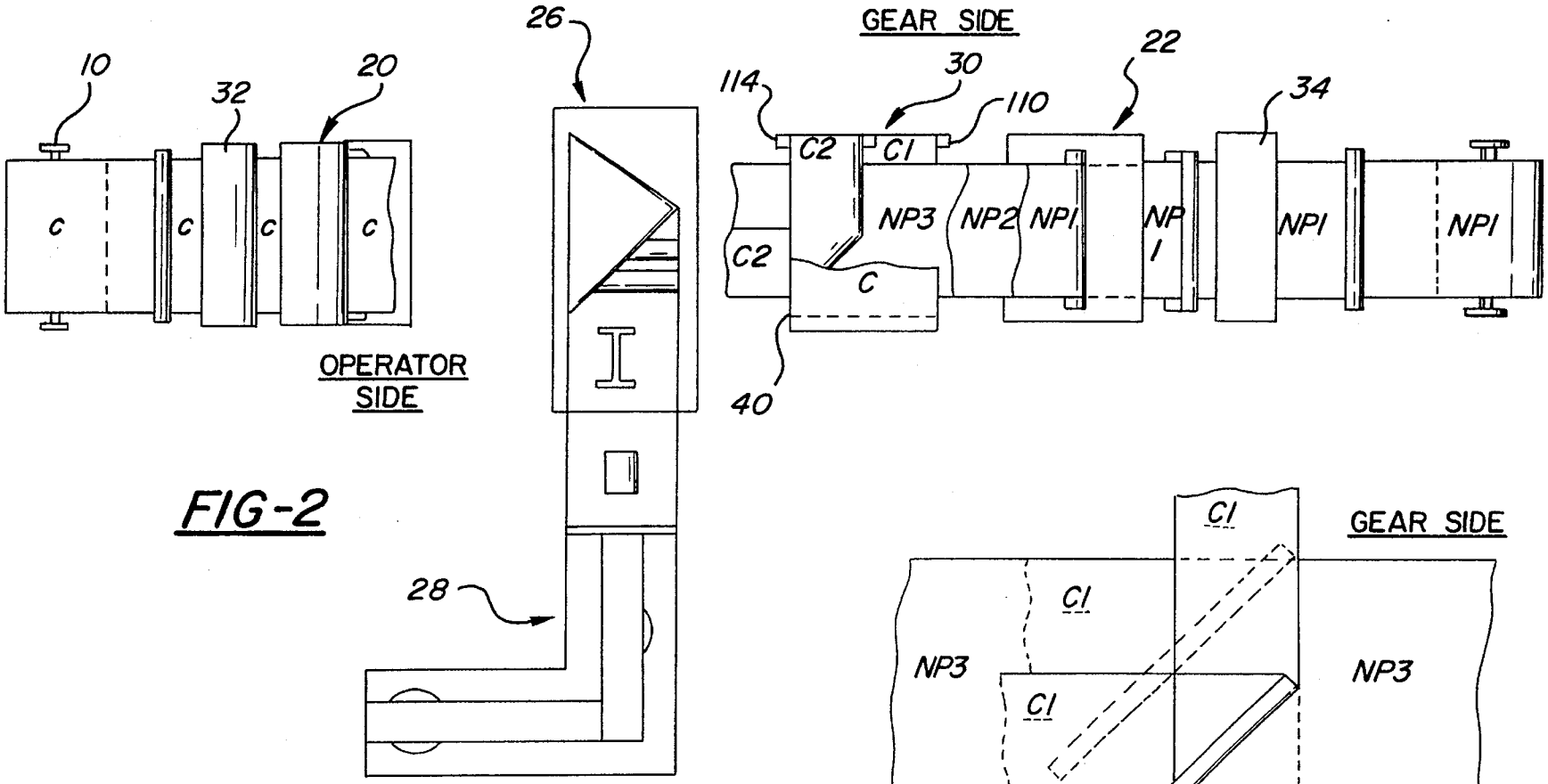
FIG. 2 is somewhat schematic plan view of the invention printing apparatus with upper portions of the apparatus omitted for clarity.

The webs NP1, NP2, NP3, C1 and C2 arrive at the entry to the folder in vertically stacked relation. As the superposed webs approach the top of former roller 54, each of the newsprint webs passes beneath two laterally spaced spray nozzles 58 which, as best seen in FIG. 3 and FIG. 1B, act to apply an adhesive or paste along longitudinal lines 58*a* on the respective webs. Page lines 58*a* are each spaced equidistant from the centerline of the web and a respective side edge of the web.

The superimposed webs immediately thereafter pass between the former roller 54 and the pressure roller 56 where the webs are glued together along the glue lines 58*a*, whereafter the webs pass downwardly over the former 52. As the webs reach the nose 52*a* of the former, a first fold is made in the product along the longitudinal centerline of the webs. The rollers 60 guide the webs over the former nose and help to form the fold whereafter the folded webs travel between the nipping rollers 62 which put a sharp crease in the first fold. As the webs move downwardly from the triangular edges of the former to the rollers 60, a further spray nozzle 58 positioned beneath the former 52 between the two sides of the webs serves to apply a further adhesive line **58*b* to one of the inner web surfaces formed as the web is folded around the edges of the former. After the folded web leaves roller 62 it passes through cross-perforating roller 64 and receives a further adhesive line 58*c* from a further spray nozzle 58, whereafter it passes downwardly between cutting cylinder 58 and half jaw cylinder 70 where a tucker blade on the cutting cylinder coacts in known manner with movable and stationary jaws on the half fold cylinder to tuck or fold the web, whereafter, with further relative rotation of cylinders 68 and 70, the cylinders coact in known manner to cut the web and form a book 140 which is thereafter, in coaction with fingers carried on the rear edge of the delivery board 74, passed upwardly between the rear edge of the delivery board and the roller 72 for passage on the board 74 to the quarter folder 76 which rotates in known manner and acts to put a final fold in the book, whereafter the book passes downwardly through an opening in the board 74 for delivery to fly 78 which deposits the book onto belt 80 which delivers the book to the delivery end of the folder. Folder 26** may for example comprise a Rockwell-Goss SSC Folder available from the Graphic Systems Division of Rockwell International of Chicago, Ill.

As the book leaves the delivery end of the folder, it is deposited on conveyor 90 of trimmer 28 and moved past cutter 94 which trims the face of the book, whereafter the book is deposited onto right angle conveyor 92 where it passes between trimmers 96 and 98 which respectively trim the head and foot of the book, whereafter the completed book is deposited in a suitable receptacle. Trimmer 28 may for example comprise a Model AGT 100 Series Trimmer available from AGE Corporation of York, Pa.

The completed book 140 comprises a plurality of pages of interspersed multicolor coated pages and newsprint pages adhesively bound along one of their common edges wherein each book has a front and rear cover page formed of multicolor coated paper, each book includes pages of coated paper interspersed between the cover pages with pages of newsprint paper, each page is formed of one half of a folded sheet, and the folded sheets are arranged in nested relation with all of the folds arranged on a single common centerline **140*a*** passing through the common adhesive edge.

The specific interleaved relation of the coated and newsprint pages in the finished book can be selectively varied according to the invention by selective variation of the alternate entry web paths employed for the coated web halves C1 and C2 as they enter between the newsprint webs in the interleaver.

Specifically, after being slit by roller 106, the coated web halves C1 and C2 may be passed selectively around guide rollers 110, 112, 114, 116, and 118 to determine the interleaved relation of each coated web half with respect to newsprint webs NP1, NP2, and NP3 and, by selective positioning of the related turn bars 120, 122, 124, 126, and 128, each web path may be positioned either on the gear side of the interleaver or the operator side of the interleaver with respect to the associated newsprint web. The particular interleaved relation of the coated and newsprint webs in the finished book is therefore determined by the choice of entry paths for the coated web halves C1 and C2 as they enter the interleaver and also by the positioning of each web half either on the gear side or the operator side with respect to the associated newsprint webs.

FIGS. 9–12 illustrate four of the multitude of possible interleaved relations that are possible, utilizing the invention, in the finished book.

Each of FIGS. 9–12 is divided into an A figure and a B figure with the A figure schematically depicting the relative positioning of the newsprint webs and the coated webs in the interleaver 30 and the B figure depicting the coated and newsprint page configuration in the finished book 140.

In the example of FIG. 9, web half C1 is passed around roller 110 and is positioned by turn bar 120 on the gear side of the interleaver beneath newsprint web NP3, and coated web half C2 is passed around guide roller 112 and is positioned by turn bar 122 on the gear side of the interleaver between coated web half C1 and newsprint web NP3. After leaving the interleaver, coated web halves C1 and C2 pass around guide rollers 130 and 134, respectively, for entry into the folder with the newsprint webs. After passing through the folding and trimming operations, the interleave relation shown in FIG. 9A produces the finished book configuration shown in FIG. 9B.

In the book of FIG. 9B, the two folded outer sheets of the book comprise coated sheets, the two folded centerfold sheets of the book comprise coated sheets, and 16 folded sheets of newsprint paper are positioned between the two outer folded coated sheets and the two inner centerfold coated sheets.

In the example of FIG. 10, web half C1 is passed around roller 110 and around turn bar 120 to position the web half in underlying relation to newsprint web NP3 on the gear side of the interleaver, and coated web half C2 is passed around roller 116 and around turn bar 126 to position the web half between newsprint web NP1 and newsprint web NP2 on the operator side of the interleaver. In this case, web half C1 passes around guide roller 130 for entry into the folder and web half C2 passes around guide roller 134 for entry into the folder.

The finished book, as seen in FIG. 10B, comprises an outer folded cover sheet formed of coated paper, four folded newsprint sheets positioned immediately within the folded coated cover sheet, a second folded coated sheet positioned within the four folded newsprint sheets, four more folded newsprint sheets positioned within the second folded coated sheet, a third coated folded sheet positioned within the second set of four folded newsprint sheets, four more folded newsprint sheets positioned within the third folded coated sheet, and a folded centerfold coated sheet.

In the example shown in FIG. 11, coated web half Cl is passed around roller 112 and is positioned by turn bar 120 beneath newsprint web NP3 on the gear side of the interleaver, and coated web C2 is passed around guide roller 114 and positioned by turn bar 124 between newsprint webs NP2 and NP3 on the operator side of the interleaver. In this case, coated web C1 passes around guide roller 130 for entry into the folder and coated web C2 passes around guide roller 132 for entry into the folder.

The book produced by this interleaved relation, as seen in FIG. 11B, includes a folded outer sheet of coated paper, five sheets of folded newsprint paper immediately inside of the coated cover sheet, a second folded sheet of coated paper, two folded sheets of newsprint paper within the second coated sheet, a third folded coated sheet, five more folded sheets of newsprint paper within the third folded coated sheet, and a folded coated centerfold sheet.

In the example seen in FIG. 12A, coated web half C1 is passed around roller 112 and positioned by turn bar 120 beneath newsprint web NP3 on the gear side of the interleaver, and coated web half C2 is passed around guide roller 118 and positioned by turn bar 128 above newsprint web NP1 on the gear side of the interleaver. In this case, web half C1 moves around guide roller 130 for entry into the folder and coated web half C2 moves around guide roller 136 for entry into the folder.

The finished book, as seen in FIG. 12B, includes a folded outer coated cover sheet, three folded newsprint sheets positioned within the outer folded cover sheet, a second folded cover sheet, six folded newsprint sheets positioned inside of the second folded coated sheet, a third folded coated sheet, three folded newsprint sheets positioned within the third folded coated sheet, and a folded coated centerfold sheet.

From the examples given it will be seen that a myriad of relative interleave positionings of the coated and newsprint sheets is made possible by the invention methodology and apparatus.

In addition to providing a book comprising a plurality of sheets of multicolor coated paper and a plurality of selectively interleaved sheets of newsprint paper adhesively bound along a common edge, the invention further enables the ready and selective provision of detachable coupons on any or all of the pages of the sheets of coated paper.

Figures 4, 5:
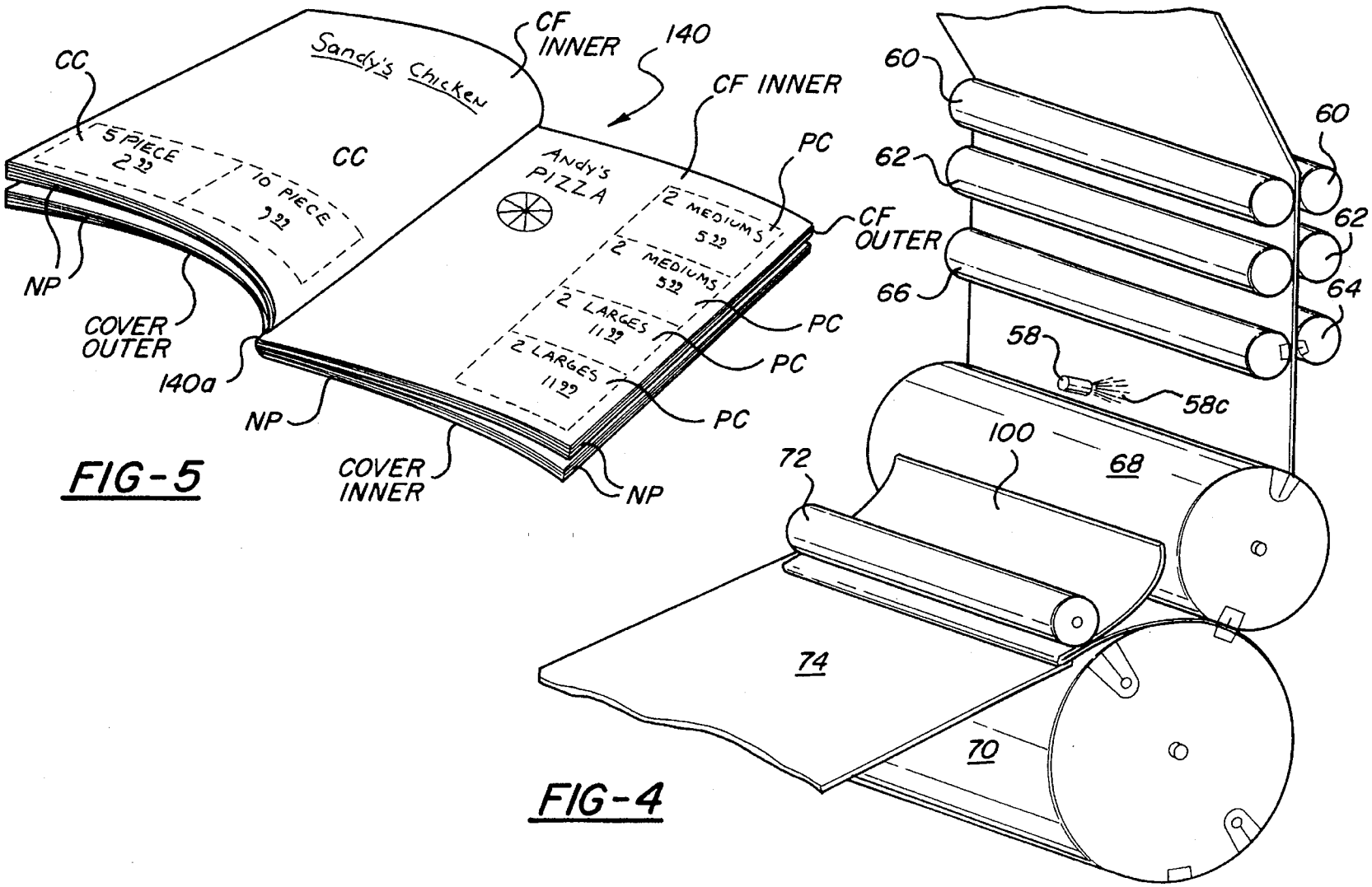
FIG. 5 is a perspective view of a book produced in accordance with the method and apparatus of the invention.
Figure 6:
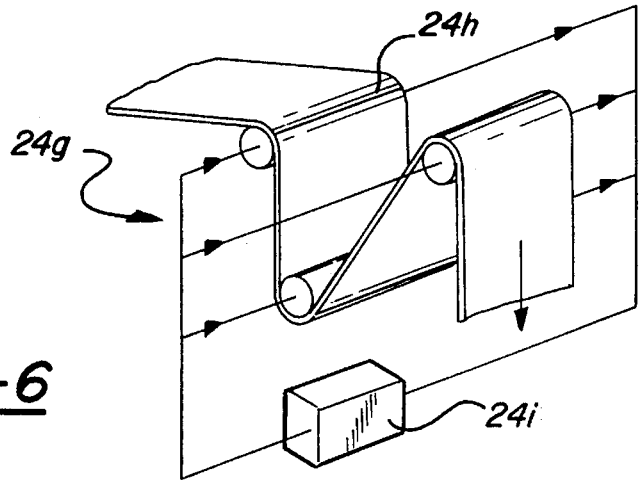
FIG. 6 is a perspective view of a chiller employed in the invention printing apparatus.
Figure 8:
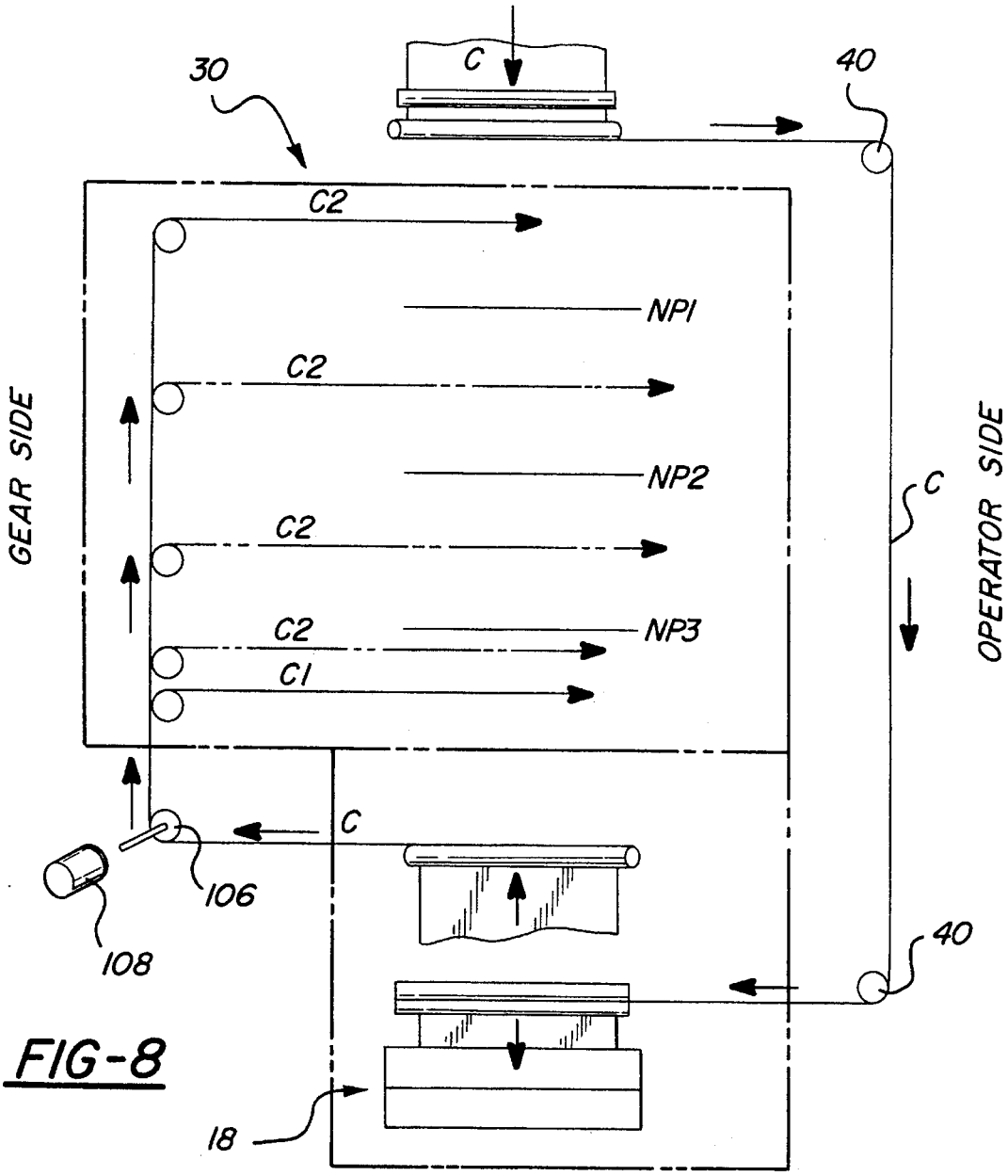
FIG. 8 schematic view looking in the direction of the arrow 8 in FIG. 7.

For example, with reference to FIGS. 1A and 5, and considering the interleave arrangement of FIGS. 9A and 9B, the perforating unit 18 may be arranged such that a series of pizza coupons PC are provided on one of the pages of the inner centerfold sheets (CF Inner) and a series of chicken coupons CC are provided on an opposing page of the inner centerfold sheet. As seen in FIG. 1A, perforating roll 18*b* is configured to perforate the coated web passing thereby in a manner to provide four vertically stacked pizza coupon perforations outlined in an area of the web that will ultimately become one of the pages of the inner center fold sheet (CF Inner) and to provide a series of perforations outlining a plurality of chicken coupons CC on the area of the web that will ultimately become the opposing page of the inner centerfold sheet. Obviously, the perforating cylinder 18*b* may be arranged to provide perforated coupon areas at any of the areas of the coated web passing therebetween, including the areas identified as Cover Inner and Cover Outer, but it would ordinarily not be desirable to provide perforation areas on the area that will become the outer cover to avoid defacing the outer cover upon detachment of the coupons. It will be of course understood that the printing couples 20*b*, 20*c*, 20*d*, and 20*e* are arranged so as to print single color or multicolor coupon indicia within the areas outlined by the perforating roller 18*b* so as to provide the desired color and information within each coupon area outlined by the perforating roller.

The invention will be seen to provide a method and apparatus for producing a booklet of interspersed coated pages and newsprint pages in a cost-effective manner. More specifically, the invention will be seen to provide a method and apparatus for producing a book of interspersed coated and newsprint pages in which the book is produced in a total, continuous on-press run. The invention allows the ready and inexpensive provision of a book having a number of glossy coated pages so as to enhance the attractiveness of the book to advertisers by offering a relatively large quantity of glossy, four-color advertising space in a given size book. The invention method and apparatus further allows the ready provision of detachable coupons on the glossy, four-color advertising pages to further enhance the appeal of the book to advertisers. The invention method and apparatus further allows the relative positioning of the newsprint and coated pages to be readily varied to provide any one of a myriad of relative position combinations depending upon the advertising requirements of the particular book being produced.

Whereas a preferred embodiment of the invention has been illustrated and described in detail, it will be apparent that various changes may be made in the disclosed embodiment without departing from the scope or spirit of the invention.

I claim:

1. A book comprising a plurality of pages of interspersed multi-color coated pages and newsprint pages adhesively bound along one of their common edges wherein said book has a front and rear cover page formed of multi-color coated paper and includes a first plurality of pages of coated paper disposed between the cover pages and a second plurality of pages of newsprint paper disposed between the cover pages and interspersed with said first plurality of coated pages, each of said first and second pluralities of pages being formed as one half of a folded sheet, and the folded sheets being arranged in nested relation with all of the respective folds thereof being arranged on a single common center line passing through the common adhesively bound edges.

2. A book according to claim 1 wherein:

at least one of the pages of coated paper interspersed between the cover pages with the pages of newsprint paper includes perforations around coupons printed on the one coated paper page so as to facilitate separation of the coupons from the one coated paper page.

3. A book comprising a plurality of pages of interspersed multi-color coated pages and newsprint pages adhesively bound along one of their common edges wherein said book has a front and rear cover page formed of multi-color coated paper and includes a first plurality of pages of coated paper disposed between the cover pages and a second plurality of pages of newsprint paper disposed between the cover pages and interspersed with said first plurality of coated pages, the book including a sheet of coated paper folded about its center line to form first and second centerfold pages, and a sheet of newsprint paper disposed between the cover pages and the centerfold pages and folded about its center line to form first and second newsprint pages, the fold of the coated centerfold sheet being nested in the fold of the newsprint sheet.

4. A book according to claim 3 wherein:

at least one of the pages of coated paper interspersed between the cover pages with pages of newsprint paper includes perforations around coupons printed on the coated paper page so as to facilitate separation of the coupons from the coated paper page.

* * * * *

UNITED STATES PATENT AND TRADEMARK OFFICE

CERTIFICATE OF CORRECTION

PATENT NO. : 5,547,225
DATED : August 20, 1996
INVENTOR(S) : Andrew V. DeAngelis It is certified that error appears in the above-indentified patent and that said Letters Patent is hereby corrected as shown below:

Column 3, line 65, after "is" insert --a--.

Column 4, line 7 insert the following paragraph

Figure 7:
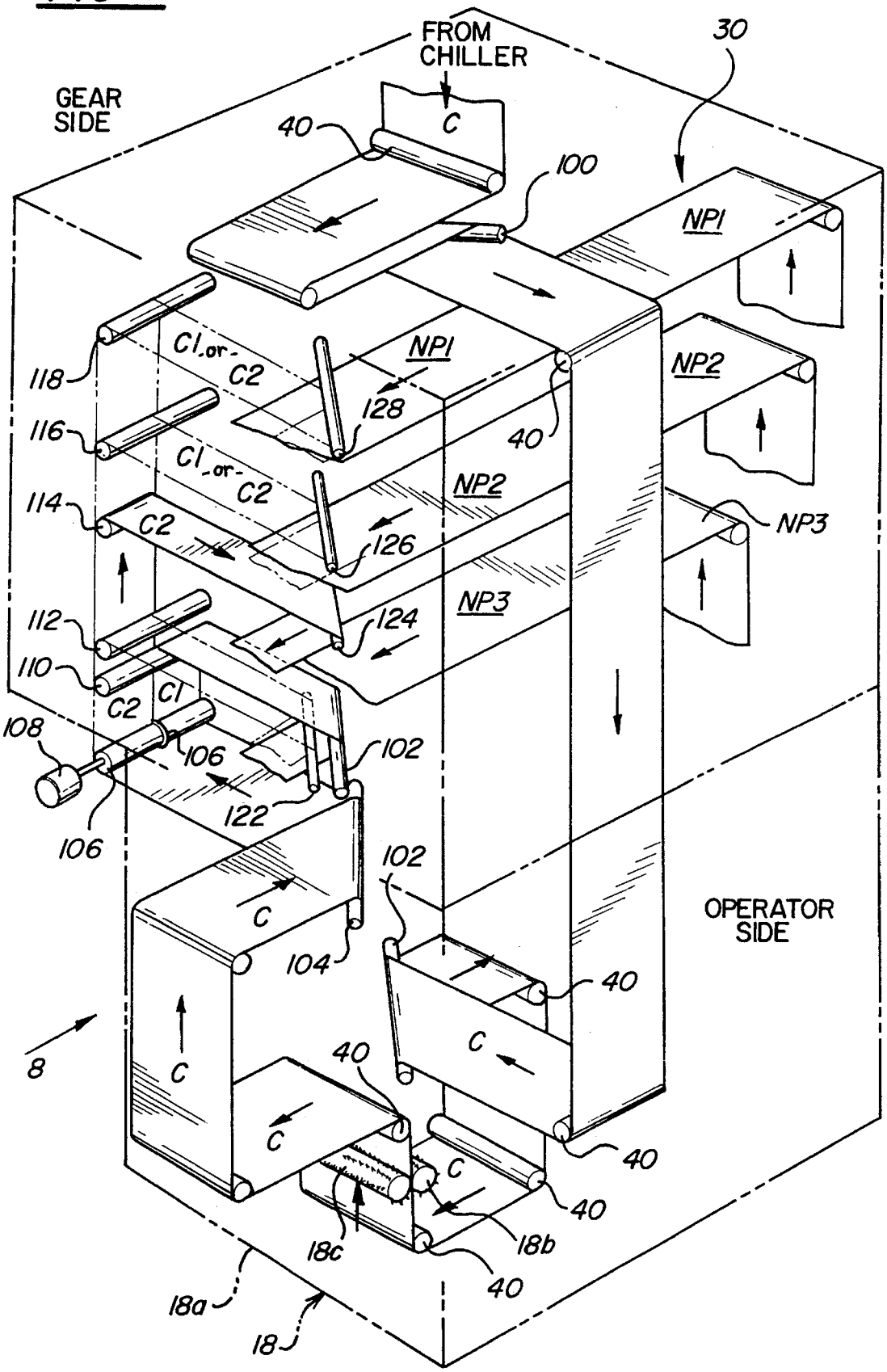

--FIG. 7 is a schematic, perspective view of an interleaver and a perforator employed in the invention printing apparatus;--

Column 4, line 7 after "8" insert --is a--.

Signed and Sealed this

Twenty-second Day of July, 1997

Bruce Lehman

*Attest:*

BRUCE LEHMAN

*Attesting Officer*

*Commissioner of Patents and Trademarks*